US005375804A

United States Patent [19]

Levilly

[11] Patent Number: 5,375,804

[45] Date of Patent: Dec. 27, 1994

[54] PORTABLE DEVICE FOR IMMOBILIZING INDIVIDUAL FIREARMS DURING ADJUSTMENT FIRING

[76] Inventor: Philippe Levilly, Le Mont Mort, 14260 Saint Agnan, France

[21] Appl. No.: 58,107

[22] Filed: May 6, 1993

[30] Foreign Application Priority Data

May 7, 1992 [FR] France ..... 92 05643

[51] Int. Cl.[5] ..... E04G 3/00

[52] U.S. Cl. ..... 248/274; 42/94; 73/167; 89/37.04

[58] Field of Search ..... 248/274; 73/167; 89/37.04; 42/94

[56] References Cited

U.S. PATENT DOCUMENTS

| | | | |
|---|---|---|---|
| 499,315 | 6/1893 | Borchardt | 42/94 X |
| 882,988 | 3/1908 | Aloyos | 42/94 X |
| 1,042,357 | 10/1912 | Livtschak | 89/37.04 |
| 2,378,545 | 6/1945 | Fraser | 89/37.04 X |
| 2,582,140 | 1/1952 | Leek | 73/167 |
| 3,041,938 | 7/1962 | Seabrook | 42/94 X |
| 3,358,504 | 12/1967 | Freebairn | 89/37.04 X |
| 3,652,152 | 3/1972 | Thurby | 248/274 X |
| 4,333,385 | 6/1982 | Culver | 89/37.04 |
| 4,409,826 | 10/1983 | Wegner . | |
| 4,621,563 | 11/1986 | Poiencot | 89/37.04 |
| 5,070,636 | 12/1991 | Mueller | 42/94 |
| 5,081,783 | 1/1992 | Jarvis | 42/94 |

FOREIGN PATENT DOCUMENTS

| | | |
|---|---|---|
| 0046181 | 2/1982 | European Pat. Off. . |
| 9010200 | 11/1990 | Germany . |

*Primary Examiner*—J. Franklin Foss

*Attorney, Agent, or Firm*—Seidel, Gonda, Lavorgna & Monaco

[57] ABSTRACT a) Portable device for immobilizing individual firearms during adjustment firing b) Device characterized in that it comprises a seating intended to be attached to an existing support (100) by attachment means (2, 3), this seating (1) supporting so as to pivot about a first axis (XX) a plate (6) which accommodates a rail (8) (axis X1X1) which in turn is mounted so as to pivot (7) on the plate (6) about a second axis (YY) which is perpendicular to the first axis (XX), the rail (8) receiving in a sliding manner along its axis (X1X1) at least two plates (9, 10) with adjustment slides (13), of which the slides are perpendicular to the axis of the rail (8) (X1X1) and to the axis of pivoting (YY) of the rail, a U-shaped support (11, 12) mounted in the slide (13) of each plate (9, 10) and provided with attachment means (27, 28, 29) intended to accommodate the weapon to be adjusted.

10 Claims, 15 Drawing Sheets

PORTABLE DEVICE FOR IMMOBILIZING INDIVIDUAL FIREARMS DURING ADJUSTMENT FIRING

The immobilization of weapons by means of portable devices is conventionally performed by means of gun mounts, bipods, tripods or trestles, on which loads such as bags of sand, rocks etc can be disposed in order to improve the stability of the assembly, of which however the stability is random, since the configuration of these support systems does not permit accommodation of large additional loads. Nevertheless, the efficiency of an immobilising device continues to be proportional to its weight, as well as to its capacity for clamping effectively the weapon it receives.

In fact, at the beginning of each shot, the weapon is subjected to stresses which take the form of violent displacements, and the barrel withstands complex vibratory movements, of which the amplitude and frequency have a determining influence on the distribution of the impacts in the target. It is thus obvious that in order to follow an identical trajectory, all the projectiles must clear the mouth of the barrel of the weapon at the moment when the latter occupies a single position in space. For this purpose a device which is as stable as possible must confer on the weapon a maximum level of immobility between and during each shot, in order for the corrections made on the weapon, and particularly on its sighting units, to take place from a known, constant reference position.

Conventional systems are also specific, and cannot be adapted to all individual models of weapons.

The object of the present invention is to eliminate the disadvantages of known devices and to create a portable device for immobilising individual weapon during adjustment fire, which does not have a heavy structure and enables existing supports such as a tree trunk, a pillar, a post, a sufficiently heavy part of a vehicle etc to be used, as well as being a simple installation which is quick to install.

For this purpose, the invention relates to a device of the above-described type, characterised in accordance with the first claim.

The attachment device for a weapon for the purpose of adjusting the latter is highly multi-purpose, both as far as the weapons it can receive and the conditions in which it is used are concerned.

The device enables any type of rifle, small-arm, or more generally portable weapon to be accommodated.

The weapons can be put into position whilst the user is standing, kneeling, or lying down, and by a right-handed or left-handed marksman.

The device thus avoids all parallactic problems.

The firmness of grip on the weapon also enables this device to be used for differential impact measurements, in order to determine any excessive play between the barrel and the mount.

This device can be attached to a wide range of existing supports or natural supports such as tree trunks, columns, pillars, walls, poles, or even parts of vehicles, and an intermediate part which connects the plate to the seating enables the plate to pivot relative to this part in order to correct the course.

Although the seating can be attached by any means, it is often preferable to use for this purpose two straps which are attached to the seating and to the support so as to be taut. They can for example be straps such as those used on trucks, in order to attach loads. Straps of this type enable considerable force to be exerted by means of manually manoeuvred tension devices.

The numerous possibilities of adjustment of the attachment device thus permit accommodation of an existing support which does not correspond to a specific axis (for example to a vertical axis). In fact, the various inclinations relative to a reference of coordinates can be compensated by inclining the plate relative to the base, pivoting the rail, and the by adjustment position of the U-shaped supports in the slides of the lateral plates.

Additionally, adjustment of the lateral plates on the rail enables the support device to be adapted to a large number of different weapons, as well as providing perfectly firm and accurate attachment. Furthermore, these possibilities of adjusting both the clearance of the U-shaped supports, by adjusting the clearance of the lateral plates, and the adjustment means provided on the U-shaped supports themselves, allow improved points of attachment of the weapon to be selected, in order to ensure that the latter is perfectly stable, which is essential for the purposes of accurate adjustment, as well as maintaining a comfortable visual approach and good ergonomic accessibility as far as the marksman is concerned.

Other features of the invention form the basis of secondary claims.

The attachment device is used in the most varied conditions. The assembly of parts which constitutes the multi-purpose device is very limited, and these parts are simple to produce. Since they are simple, they are also robust. In certain cases, since the lateral plates are identical, they are interchangeable, which facilitates both production and use of the device. The same also applies to the U-shaped support. The device can comprise two, symmetrical U-shaped supports. In this case the lateral plates are also mounted symmetrically. This enables the U-shaped supports to be brought as close together as possible in order to accommodate small-arms.

The various locking means of the device ensure that its form is highly stable, i.e. the accuracy of positioning of the weapon being adjusted is maintained after several shots have been fired. This stability can be reinforced for powerful weapons by stiffeners and rotational and recoil stops, as well as by additional means for locking the weapon in its supports.

The locking obtained from swivel-joint feet is particularly firm, irrespective of the geometrical shape of the support surface of the weapon.

The various adjustment devices are preferably clamped by means of hexagonal nuts which are accessible when tightened by means of spanners, and in particular ratchet spanners, which prevents the weapon having to be detached in order to correct or modify an adjustment of the device.

Thus, safety means such as detachable screws enable the movable parts, such as the U-shaped supports, to be retained at the end of the course after they have been loosened, in order to prevent them from falling and risking causing injury to the user.

To summarise, the device according to the invention permits perfect retention of a weapon for and during its adjustment, without requiring very complicated, heavy means which are difficult to transport easily.

The present invention will be described in greater detail hereinafter with the assistance of the attached drawings.

Figure 1:
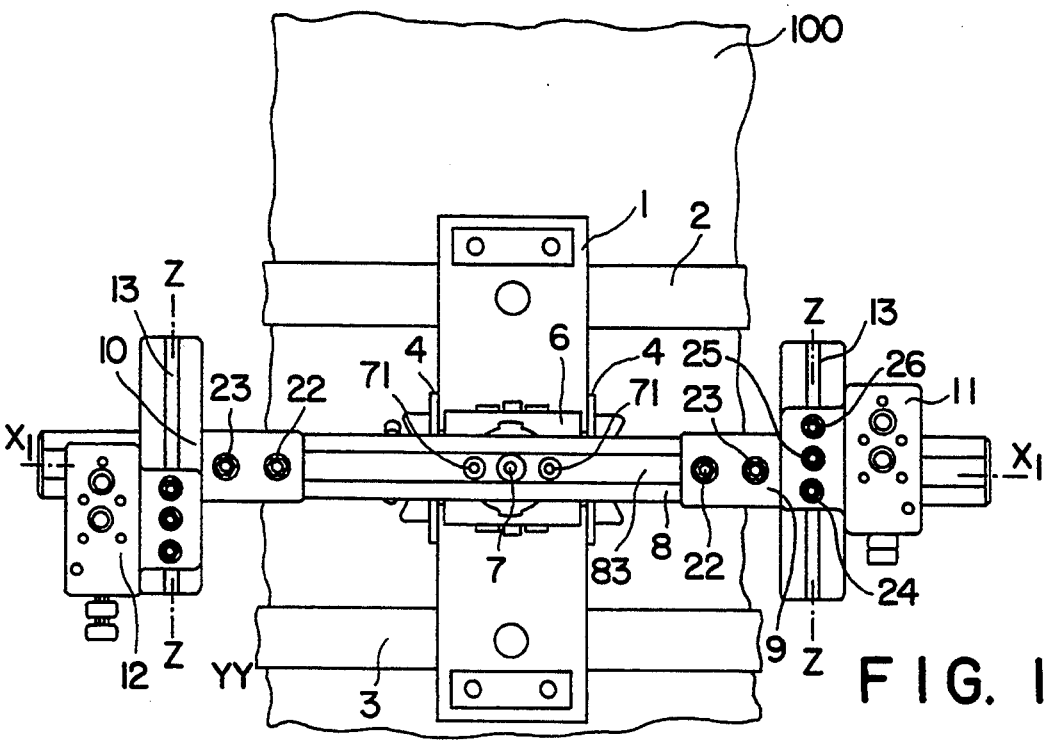
FIG. 1 is a front view of the device according to the invention attached to a tree trunk.
Figure 2:
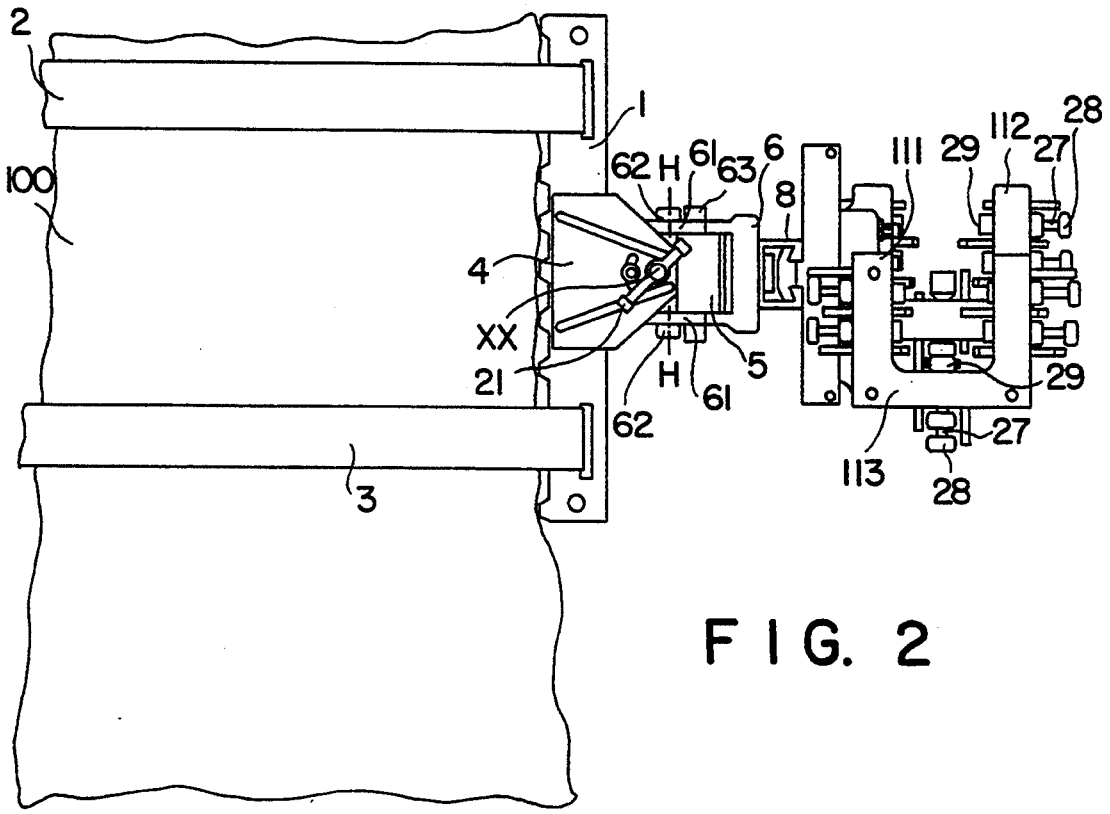
FIG. 2 is a side view corresponding to FIG. 1.

According to FIGS. 1 and 2, the portable device for immobilising individual fire arms during adjustment consists of a seating 1 provided with straps 2, 3 for attachment to an existing support 100 in the form of a shaft or column, such as a tree trunk, a pillar, a pole or similar items.

In greater detail, the seating consists of a steel profiled part, for example of the UPN type, provided if necessary with steel plate reinforcement covering parts welded in the recess of the profiled part. These covering parts preferably have a concave edge in order to enable the seating to match the rounded shape of the support such as a tree trunk. Additionally the sides of the seating can have a shape which is not straight, for example a tooled shape, such that it does not slip on the support which accommodates the seating.

According to the above-described embodiment, the seating is attached to the support by means of straps. However other methods of attachment can be envisaged, and for this purpose the base can comprise apertures and recesses for the passage of bolts, anchor bolts, clamps, as well as passages for the aforementioned attachment straps. The seating can be welded or provided with a plate to be welded on or sealed.

This seating 1 is provided with two lateral cheek pieces 4. The lateral check pieces 4 support in a pivoting and adjustable manner about an axis XX (horizontal in FIGS. 1 and 2), a plate 6 which accommodates a rail 8, by means of a pivot 7. This pivot 7 defines an axis YY (second axis YY) perpendicular to the first axis XX of pivoting of the plate.

According to an embodiment, the plate 6 is connected to the seating by an intermediate part 5, which enables the course to be corrected. This part is mounted so as to pivot about the axis XX in order to assume a horizontal position, irrespective of the inclination of the support 100. In this position it permits pivoting of the plate 6 in the horizontal plane thus defined (course correction). For this purpose the plate 6 comprises two cheek pieces 61 which straddle the intermediate part 5. The pivoting takes place about the axis HH constituted by two screws 63, and the locking is performed by two screws 62 which pass through a slot in the form of the arc of a circle, in the cheek pieces 61.

This intermediate part 5 enables the course to be regulated accurately, without having to modify the attachment of the seating 1 on the support 100.

In the arrangement shown, the axis YY is substantially horizontal and enables the axis X1X1 of the rail 8 to be determined or lowered.

The rail 8 supports two lateral plates 9, 10, which are preferably identical, and of which only one (plate 10) will be described, such that these plates slide along its axis X1X1.

These two plates 9, 10 can slide and be adjusted along the axis X1X1, such that they can be locked in the position selected, in accordance with the weapon to be adjusted.

Each plate 9, 10 carries in an adjustable manner a U-shaped support 11, 12. These supports can be identical or symmetrical, such that the description given will be limited to the support 12.

The lateral plates 9, 10 have a groove 13 with an axis ZZ perpendicular to the axis of the rail X1X1, in order to receive the U-shaped supports 11, 12, in an adjustable manner along the axis ZZ.

The various adjustable parts of the device are locked by the following means:

The seating 1 is attached to the existing support 100 (tree trunk) by the straps 2, 3 provided with tension means not shown in detail.

The course of the plate 6 is adjusted about the axis HH by means of the part 5, using the screw 63.

The inclination of the plate 6 about the axis XX is adjusted and locked in the required position by means of the crank screw 21 supported on the cheek pieces 4.

Figure 5A:
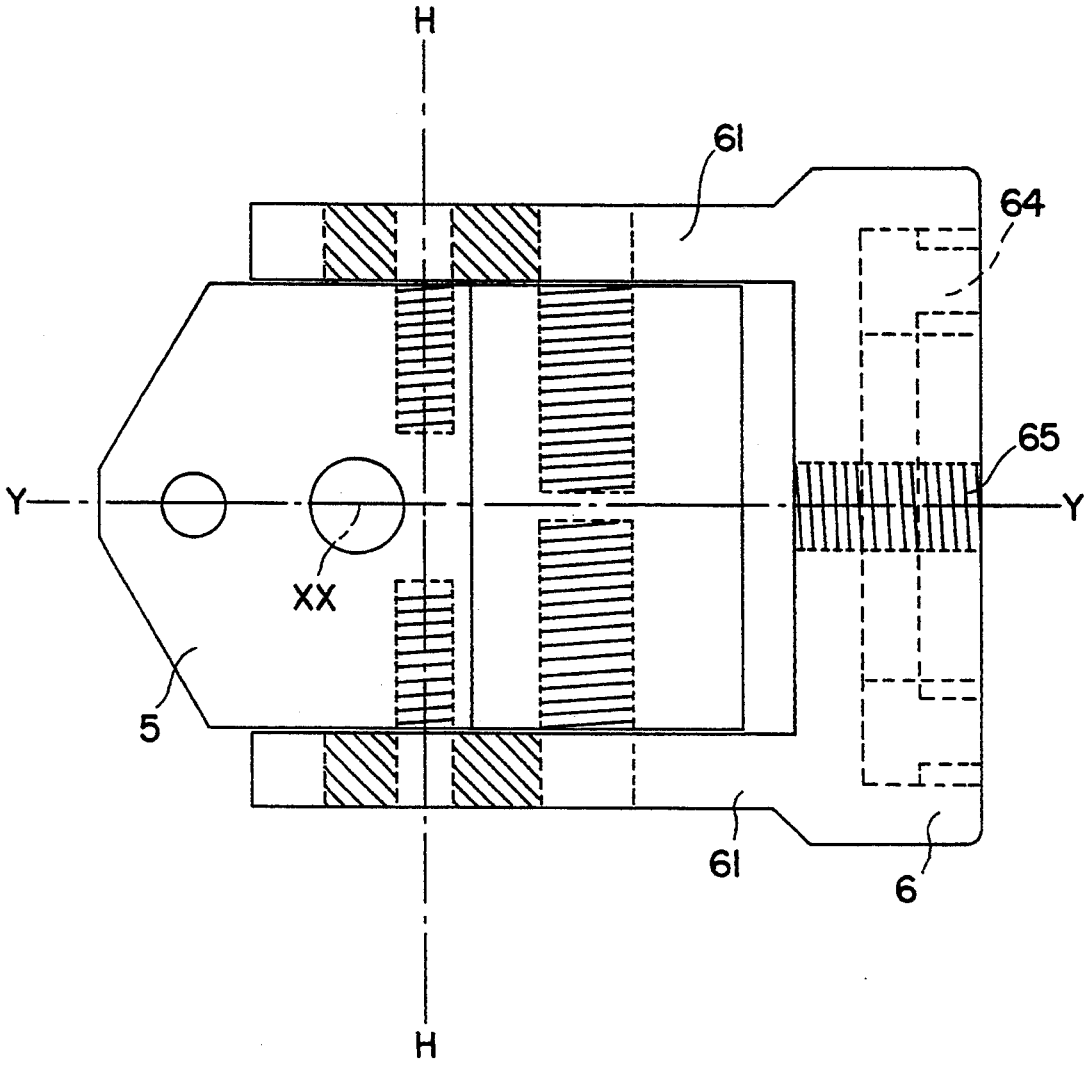
FIG. 5A is a side view of the plate and the intermediate part.
Figure 5B:
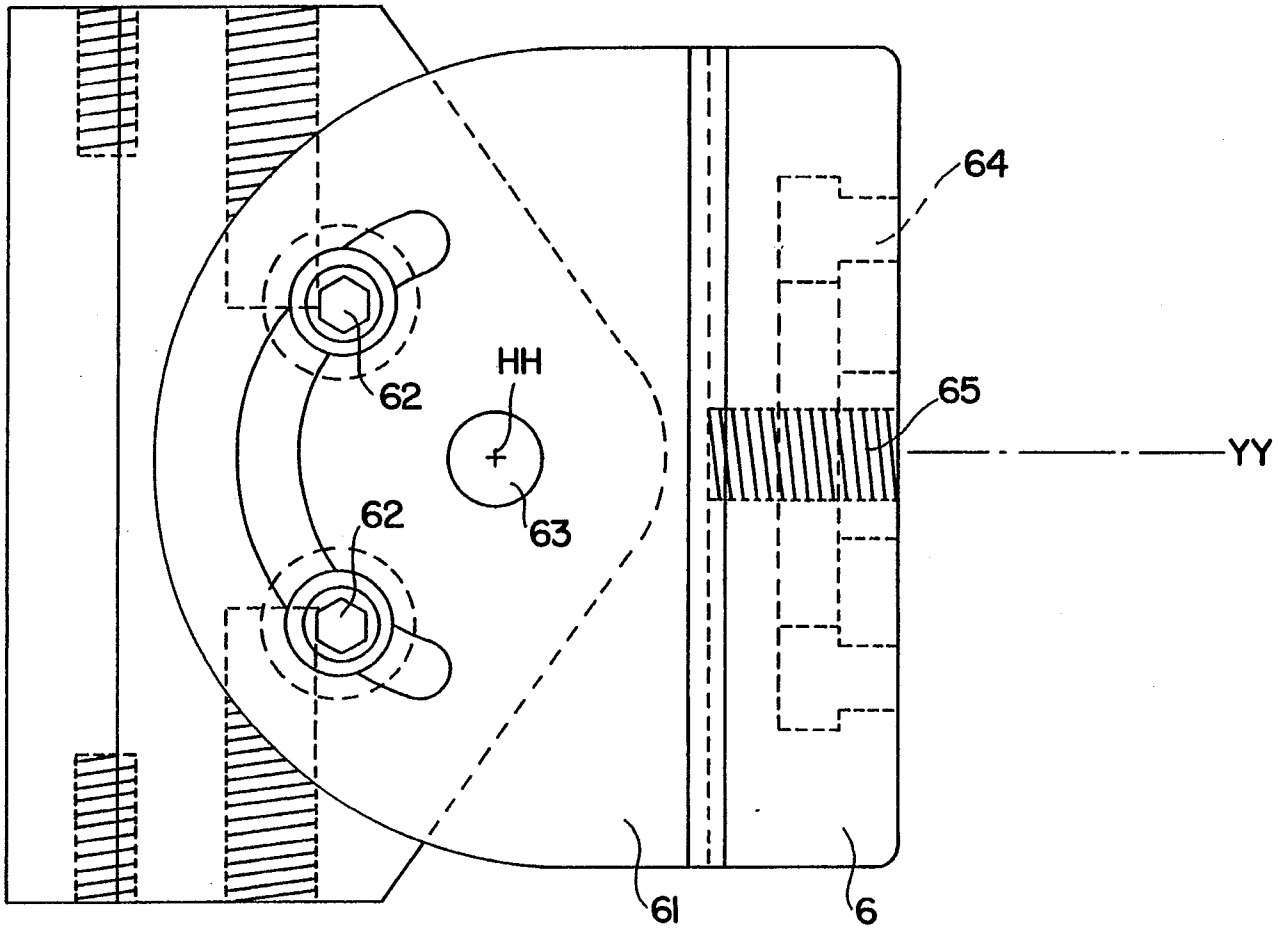
FIG. 5B is a view from above corresponding to FIG. 5A.

The inclination of the rail 8 (axis X1X1) about its axis of pivoting YY is adjusted by means of the shaft 7 constituted by a screw which is locked in the selected position of inclination. This locking by the screw 7, which also forms the axis of pivoting, is preferably completed by two bracing screws 71, of which the lug is accommodated in the circular groove 64 provided in the plate 6. FIGS. 5A and 5B show this groove 64, as well as the tapping 65 for the screw 7.

FIGS. 5A and 5B show schematically the arrangement and cooperation of the intermediate part 5 and of the plate 6, the shaft and locking screws 63, 62 not being shown.

The plates 9, 10 are attached to the rail 8 by means of hooked-head bolts 22, 23 which are supported on the lips of the rail 8, as will be described hereinafter.

The U-shaped supports 11, 12 are locked relative to the groove 13 of the corresponding lateral plate 9, 10 by means of studs provided with lugs 24, 25, 26.

Finally the weapon (not shown) is locked in the U-shaped supports 11, 12 by means of screws 27 provided with milled studs 27 for gripping, and of which the end which comes into contact with the weapon is provided with rigid joining pieces 29 which have a variable form known as "ball and socket bases" matching the form of the contact surface.

The main parts of the device will be described in greater detail hereinafter.

Figure 3A:
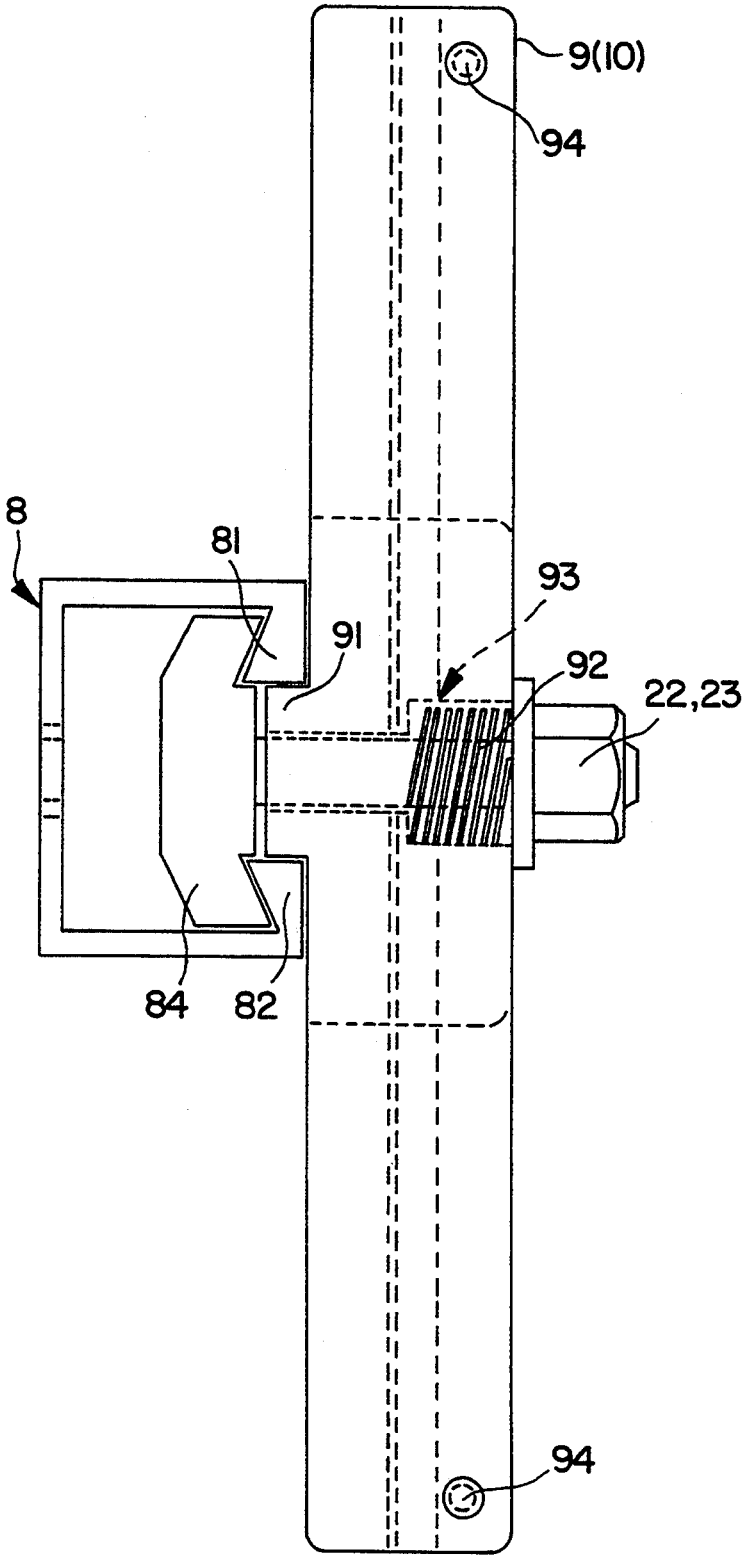
FIG. 3A is a side view of a lateral plate attached to the rail.

According to FIG. 3A, the rail 8 is a rail with a cross-section in the form of an omega, of which the lips 81, 82 define an aperture 83 used to guide and attach the plates 9, 10. For this purpose the interior of the rail accommodates two hooked-head bolts 84 which are supported on the lips 81, 82 when the screws 22, 23 of the plates 9, 10 are tightened. In order to facilitate and improve guiding, the plate 9, 10 is provided on its rear surface with an additional thickness in the form of a rule 91 having substantially the width of the slot 83 in which it penetrates and slides along the axis X1X1.

In FIG. 3A, the axis X1X1 of the rail 8 is perpendicular to the plane of the drawing.

According to the assembly shown in FIG. 3A, the screws 22, 23 are supported on a spring 92 accommodated in a preliminary aperture or countersinking 93 which precedes the aperture used for passage of the bodies of the screws 22, 23. The lateral plates 9, 10 comprise upper and lower bores for the passage of a cam or driving bolt.

Figure 3B:
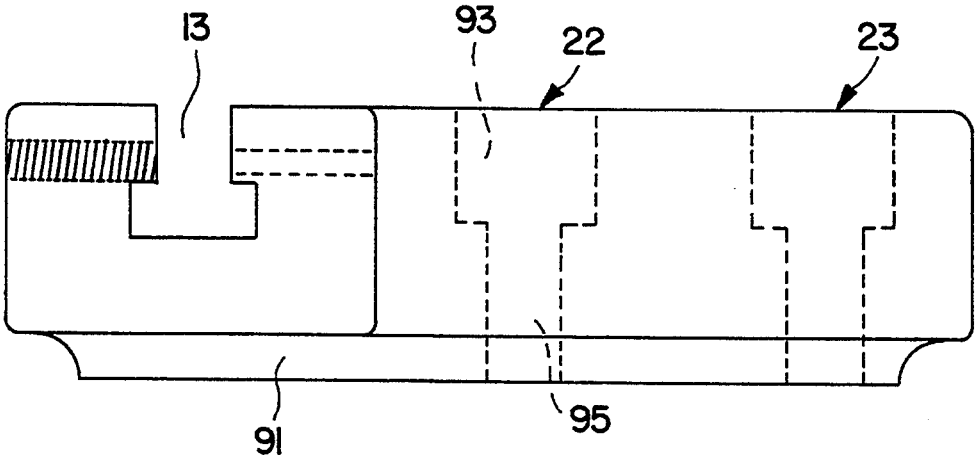
FIG. 3B is a view from below of the lateral plate in FIG. 3A, without the rail.

The view from below in FIG. 3B shows recesses for the screws 22, 23 with their driving bolts 93 and the aperture 95 for accommodating the spring and body of the screws 22, 23 respectively.

This figure also shows the form of the groove 13 in an inverted T-shaped cross-section, as well as the shape of the rule which forms a slide 91.

Figure 3C:
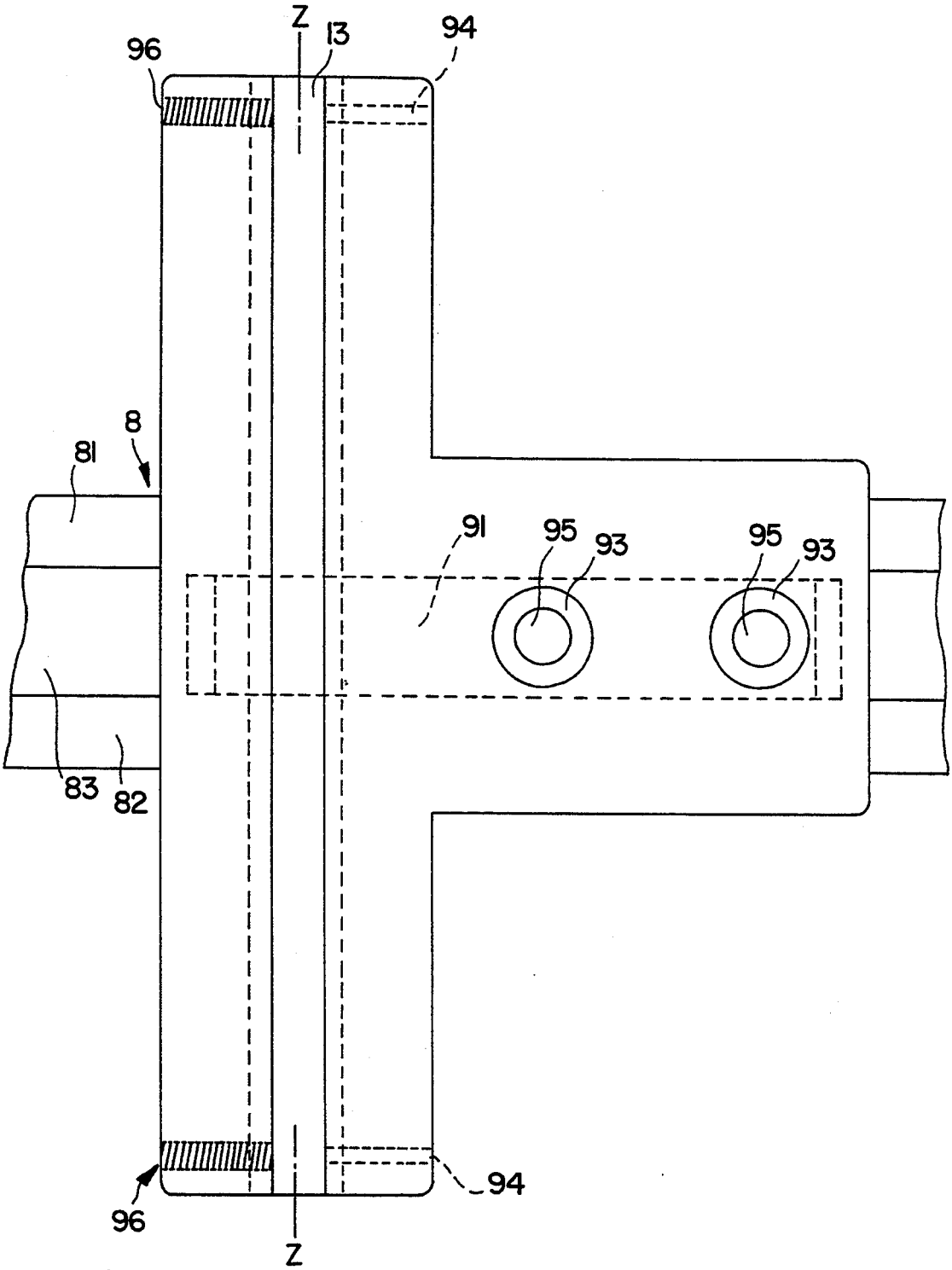
FIG. 3C is a front view of the lateral plate attached to its rail.

More particularly, FIG. 3C shows the rail 8 with its lips 81, 82 and the form of a lateral plate 10 (9), on a scale which is enlarged in comparison with FIG. 1. According to this enlarged view, the lateral plate 10 (9) has a "vertical" leg which defines the slide 13, and a horizontal leg which supports the slide rule 91. This horizontal rule permits access to the screws (not shown) 22, 23 in the bores 95, in a manner which is free relative to the slide 13.

Finally, on the its upper and lower part, the vertical leg has tappings 96 which can receive "hexagonal socket" springer thrusters which act as stops for the U-shaped supports, in order to prevent the latter from falling to the ground (or onto the feet) when the studs provided with lugs are released in the slide 13. The bores 94 permit the passage of a "cam" for pushing the head of the spring thrusters in order to enable the stud lugs to be displaced.

Figure 4A:
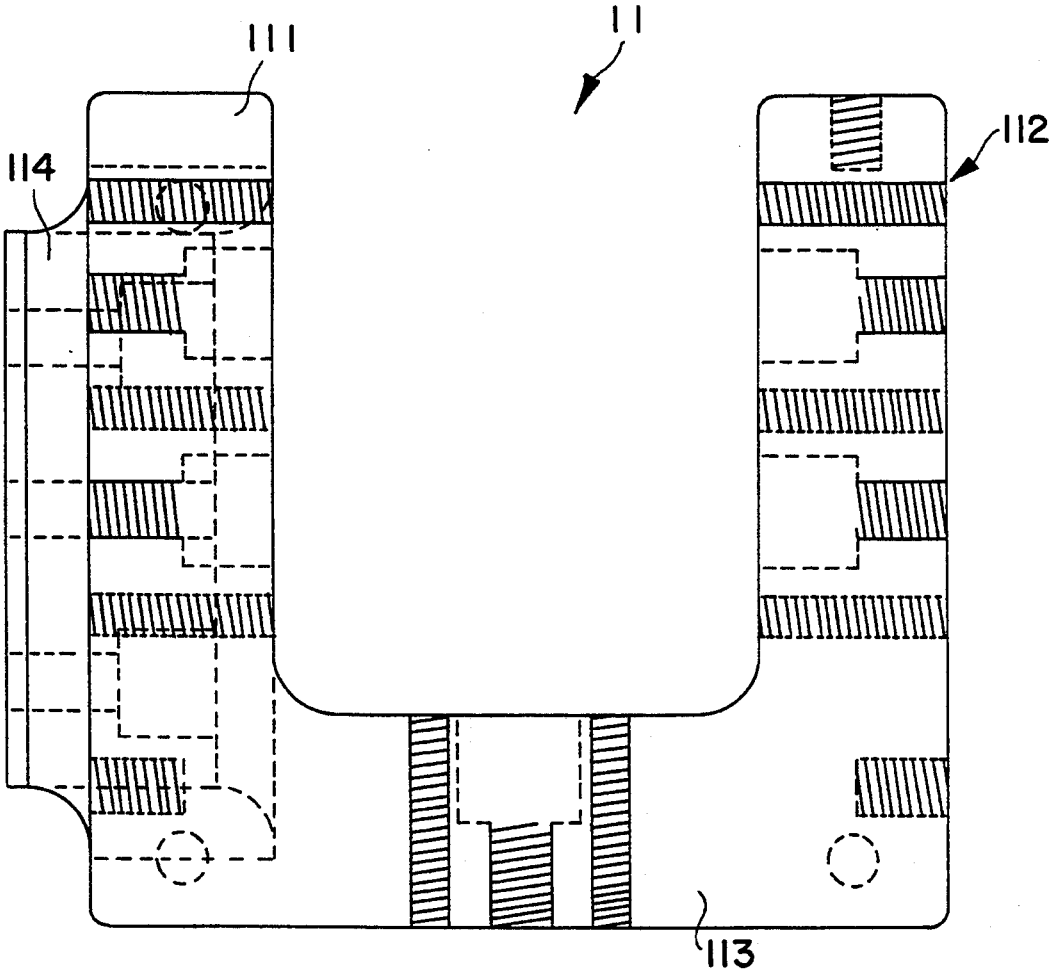
FIG. 4A is a side view of a U-shaped support.
Figure 4B:
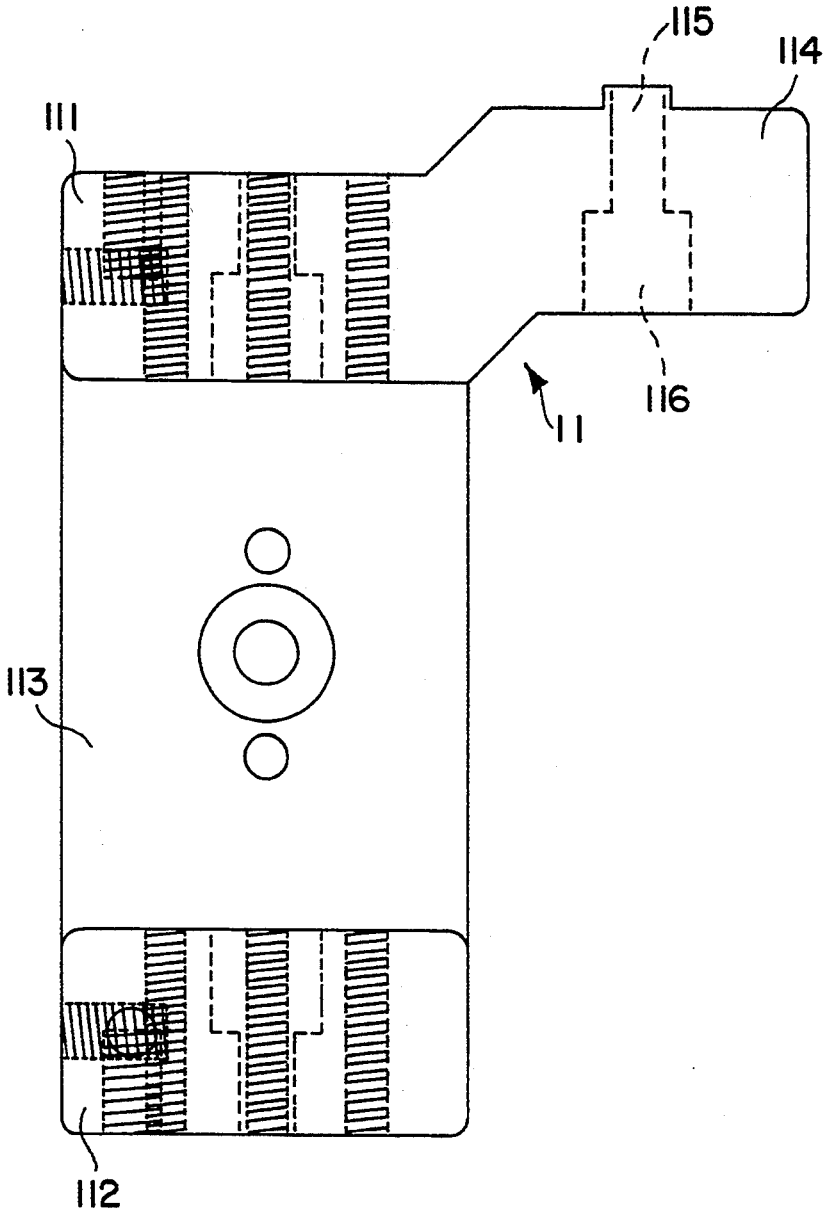
FIG. 4B is a view from above of the support in FIG. 4A.
Figure 4C:
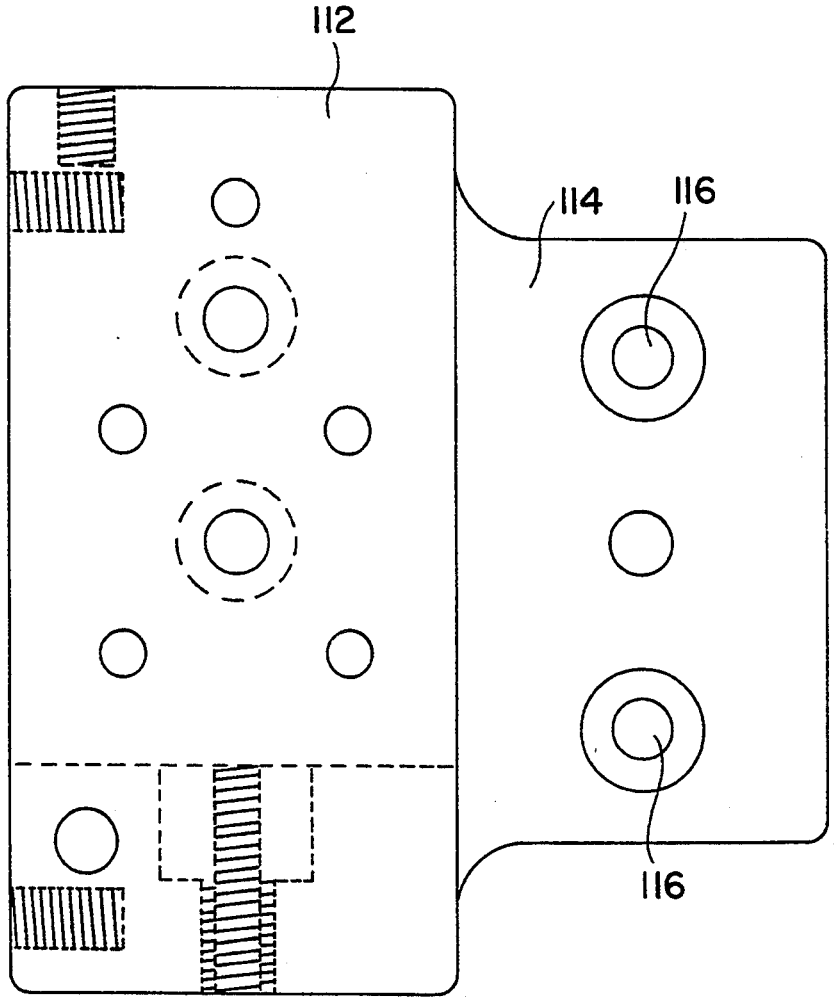
FIG. 4C is a front view of the U-shaped support in FIG. 4A.

The U-shaped support 11 shown in FIGS. 4A, 4B, 4C consists of a part which is in the shape of a "U" (FIG. 4A) with two vertical legs 111, 112 connected by a horizontal leg 113. These legs are provided with bores and tappings for accommodating the pressure screws equipped with ball and socket bases for clamping the part of the fire arm to be regulated.

The leg 111 of the U-shaped support disposed on the side of the lateral plate 9, 10 is provided with an attachment flange 114 with a rule having a T-shaped cross-section 115 which is accommodated in the groove 13. The locking is performed by means of studs provided with lugs and seating nuts.

FIG. 4B is a view from above of the U-shaped support 11, showing the two vertical legs 111, 112 and the horizontal leg 113 with the various bores and tappings.

The U-shaped support 11 is clamped in the groove 13 with an inverted T-shaped cross-section as previously described, by means of clamping lugs accommodated in the groove and supported against the inner surface of the lips of the groove. These lugs are carried by studs disposed in the recesses 116 of the projection 114.

This FIG. 4B also shows the various tappings which accommodate the locking and adjustment screws (not shown) supported on the weapon.

The side view in FIG. 4C is a view of the corresponding part shown in FIG. 1.

The U-shaped supports 11, 12 are symmetrical according to FIG. 1. The lateral plates are preferably attached to the rail in the appropriate position, such that the clamping components of the lateral plates are not covered by the U-shaped support. Additionally the attachment flange of the U-shaped support frees this support sufficiently to permit access to the various adjustment and locking screws of the weapon in the support.

Figure 6:
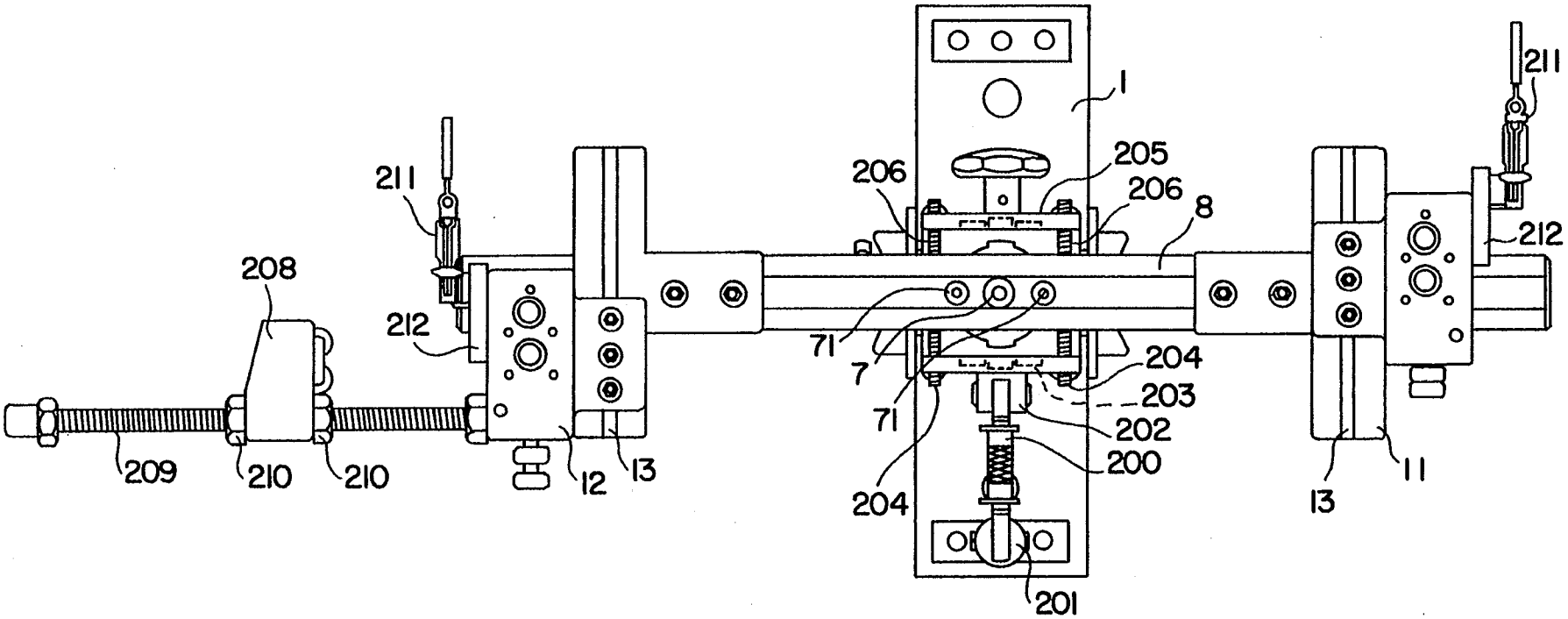
FIG. 6 is a front view of a variant of the device according to FIG. 1.
Figure 7:
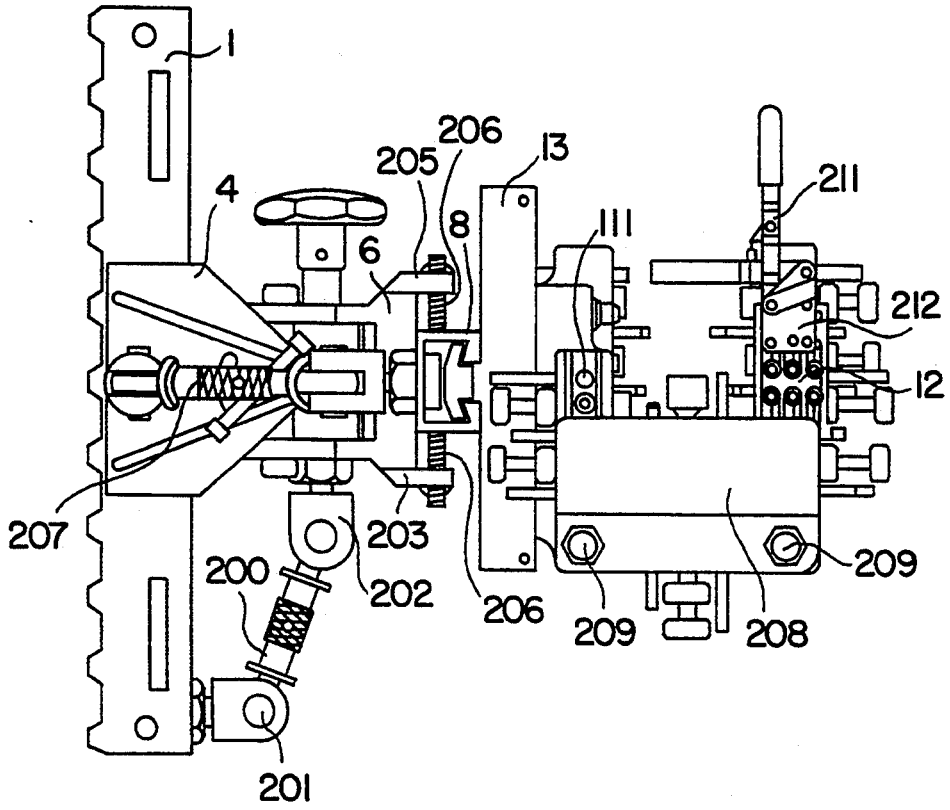
FIG. 7 is a side view of the device in FIG. 6.

The variant of the device according to FIGS. 6 and 7 corresponds substantially to the embodiment shown in FIGS. 1 and 2, and thus identical parts have the same references, and their description will not be repeated in detail.

The variant is distinguished by additional means which provide a more rigid hold and improved attachment for powerful weapons.

Thus, the portable device for immobilising a weapon according to FIGS. 6 and 7 is completed by a first stiffener 200 which connects the seating 1 to the plate 6 by means of a lower articulation 201 and an upper articulation 202 (FIG. 7). The stiffener 200 consists of two threaded rod parts with opposite pitches, these rods being connected by one of their ends to one of the articulations 201, 202, and at their other end they are screwed into a sleeve which itself has a double, opposite pitch thread. Rotation of the sleeve in one direction screws the threaded rods and draws them together; rotation of the sleeve in the opposite direction screws the threaded rods and draws them apart. A stiffener of this type is known per se.

The stiffener 200 reinforces locking of the device about the axis XX. A second stiffener, not shown, can be provided on the other side of the axis XX, in order to act in the opposite direction.

The rigidity of the immobilisation device is also completed by a double site aiming stop (FIGS. 6, 7) in order to lock rotation about the axis YY; this device comprises plates 203, 205 which are attached respectively beneath and on the plate 6, below and above the rail 8. Sets of two screws 204, 206 are screwed into the plates 203, 205, in order to support the lower surface and the upper surface of the rail 8 and lock it as a complement to the locking provided by the screws 71 (FIG. 6).

Movement about the axis ZZ is blocked by a stiffener 207 (FIG. 7) fitted between a lateral cheek piece 4 of the seating 1 and the plate 6. The stiffener can also be completed by another stiffener, not shown, which is partially symmetrical relative to the axis ZZ and acts in the opposite direction.

Figure 11:
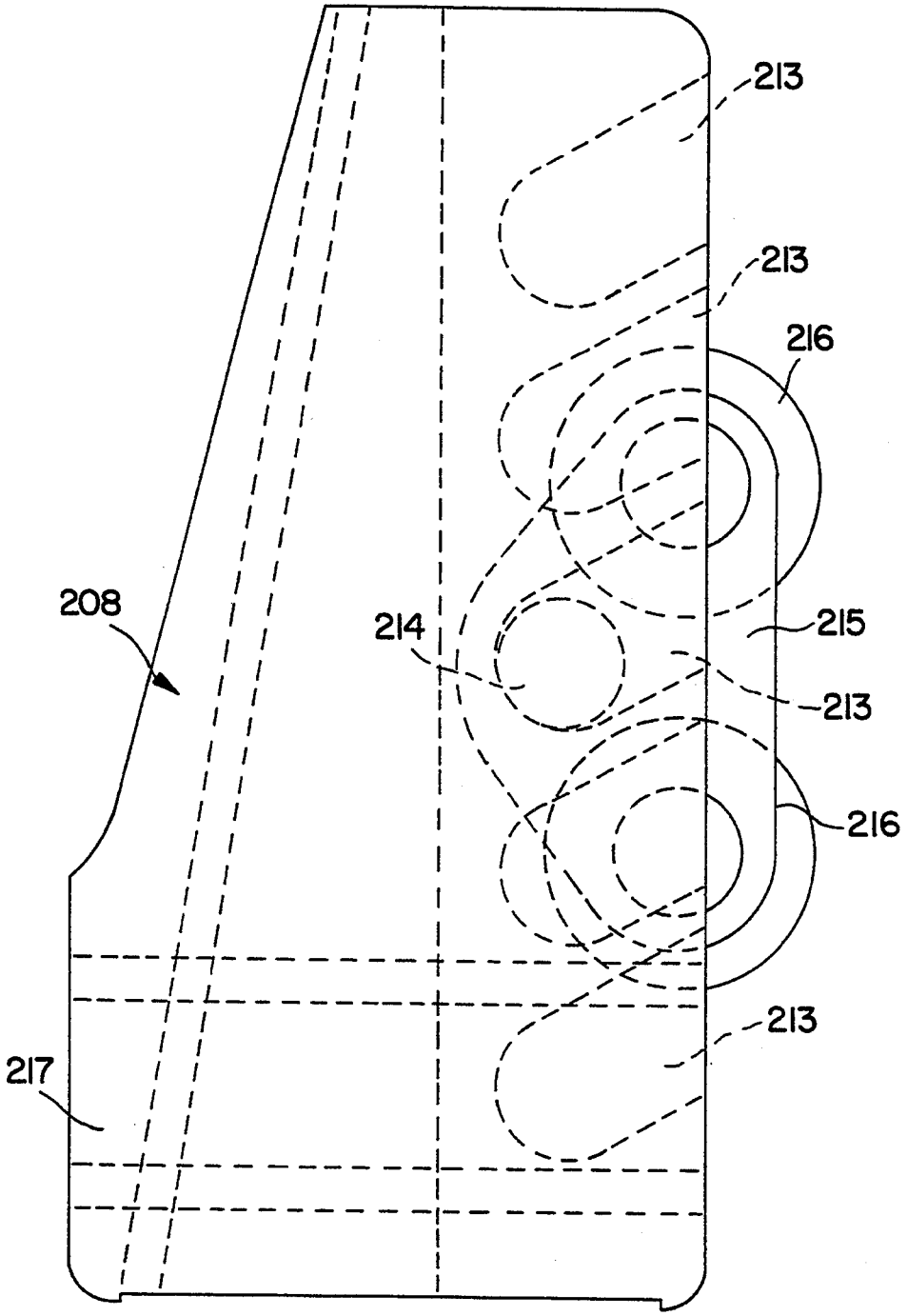
FIG. 11 is a view of the recoil stop.

The longitudinal movement of the weapon is locked by a recoil stop 208 (FIGS. 6, 8) which can be adjusted longitudinally. This stop consists of a part in the shape of a U seen from above. The stop 208 is adjusted and locked onto two threaded rods 209 which pass through the stop 208; the stop is attached to the threaded rods 209 by sets of two nuts 210 in each case. The threaded rods 209 are themselves integral with the rear U-shaped support 12. The stop 208 comprises supports means of the weapon butt plate, as will be described hereinafter (FIG. 11).

Figure 8:
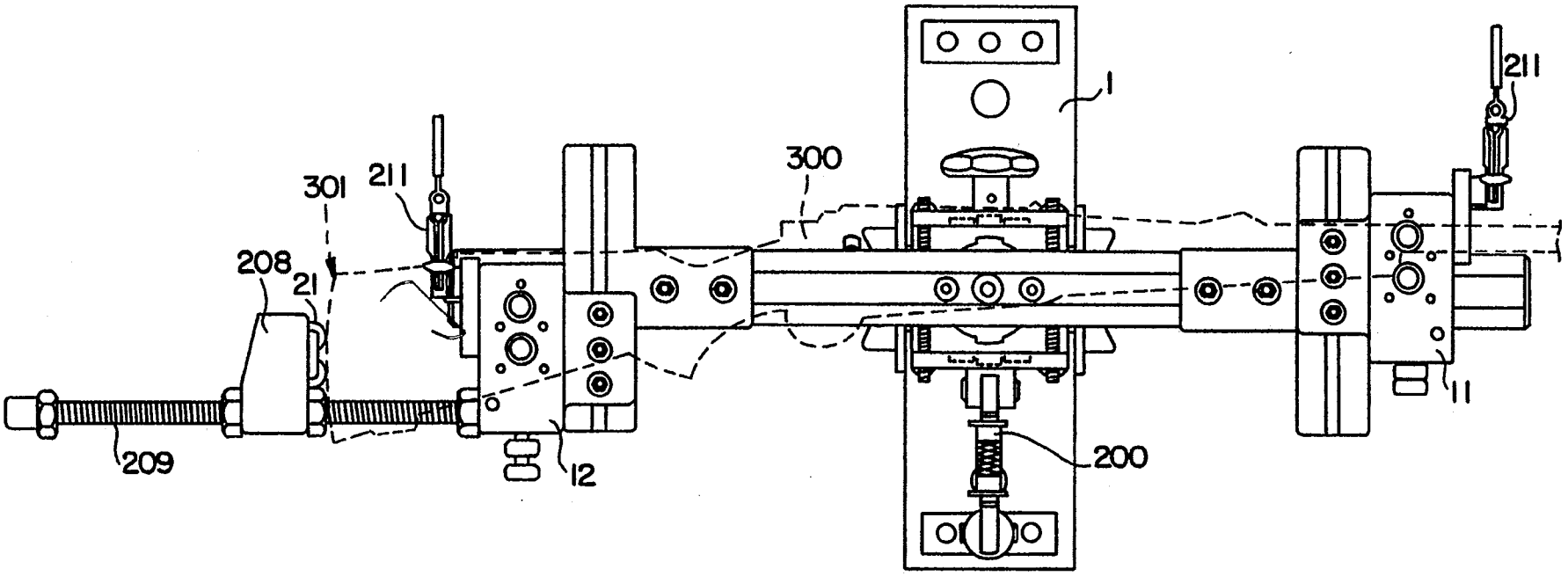
FIG. 8 is a view identical to that in FIG. 6, with a weapon outlined in the locking position in the device.

FIG. 8 shows the insertion of a rifle 300 shown only in the form of its silhouette in dotted outline in the device according to the invention, showing the butt plate 301.

In addition to the screw locking means provided on the supports 11, 12, the device comprises vertical flanging units in the form of known clips, which in each case are supported by a plate 212 mounted on the supports 11, 12. These flanging means prevent the weapon from rising under the effect of the impact caused by the shot being fired.

Figure 9:
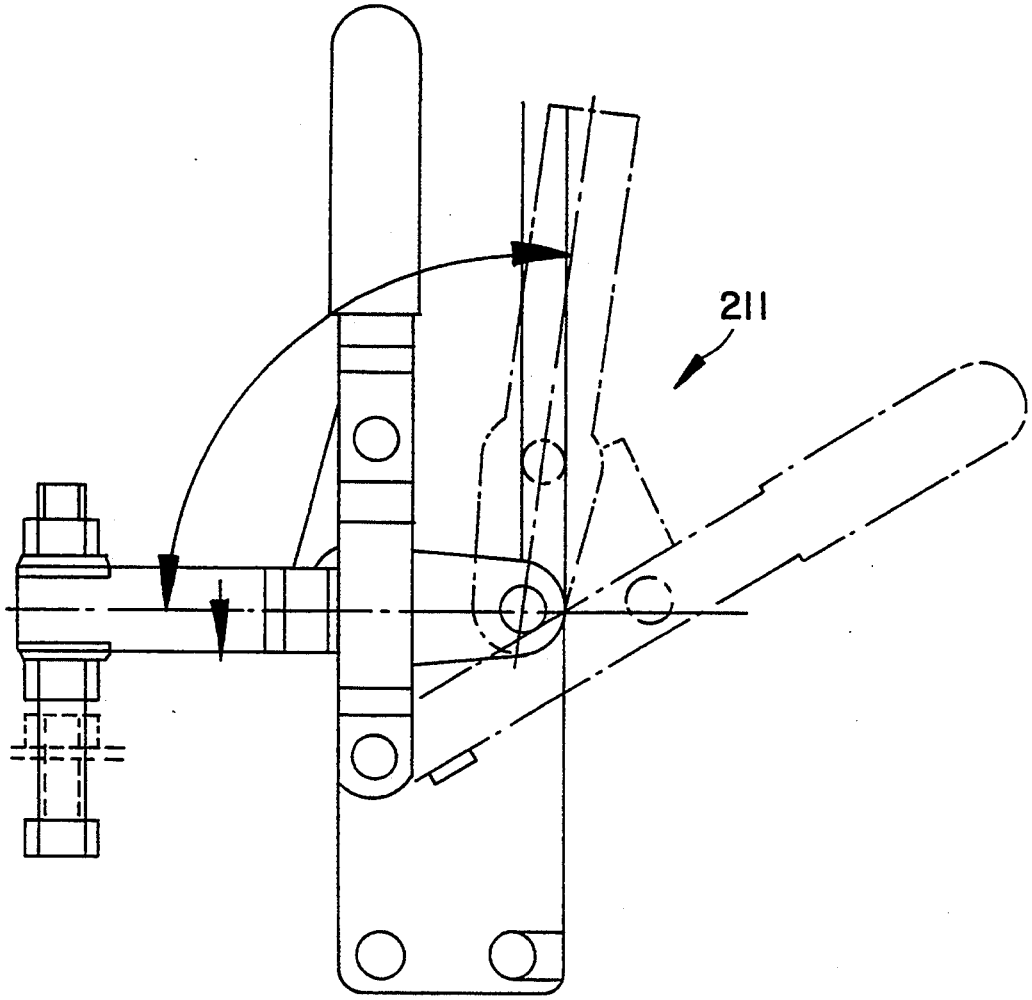
FIG. 9 is a side view of a vertical locking unit.
Figure 10:
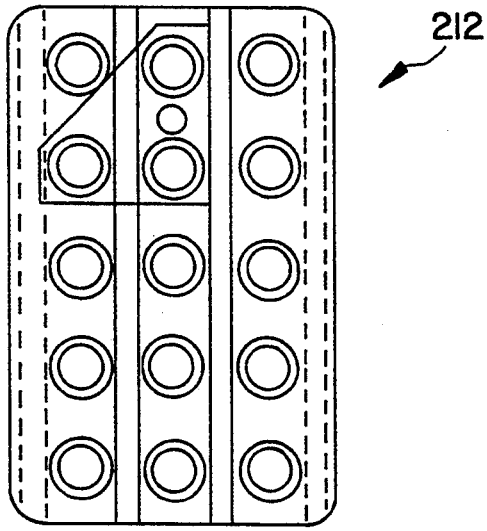
FIG. 10 is an attachment plate of a locking unit according to FIG. 9.

FIG. 9 shows a flanging unit 211 of this type in the clamping position (continuous line) and in the released position (combined line). This unit 211 is attached to a plate 212 (FIG. 10) with multiple attachment points; this plate is itself attached to one of the supports 11, 12.

FIG. 11 shows the recoil stop 208 and its support means for the butt plate 301 (not shown in this Figure).

Seen from above, the stop 208 has a U-shape, of which the two legs have on their opposite surfaces a plurality of grooves (or countersinkings) 213 (five in the embodiment shown), the grooves 213 are associated in pairs on the opposite surfaces of the legs of the U, in order to form recesses, each of which receives the end of a shaft 214 supporting two plates 215, which in turn accommodate rollers 216 which form the actual support surfaces for the butt plate. The support stopped by the stop 208 for the butt plate is thus adjustable not only longitudinally, owing to the threaded rods 209 which pass into the bores or tappings 217, but also vertically, the assembly formed by the rollers 216, the plates 215 and the shaft 214 being able to be disposed in the two appropriate grooves 213. Finally, pivoting of the assembly 216, 215, 214 about the shaft 214 in the groove 213 enables the inclination of the support surface (rollers 216) to be adapted to that of the butt plate 301.

Figure 12:
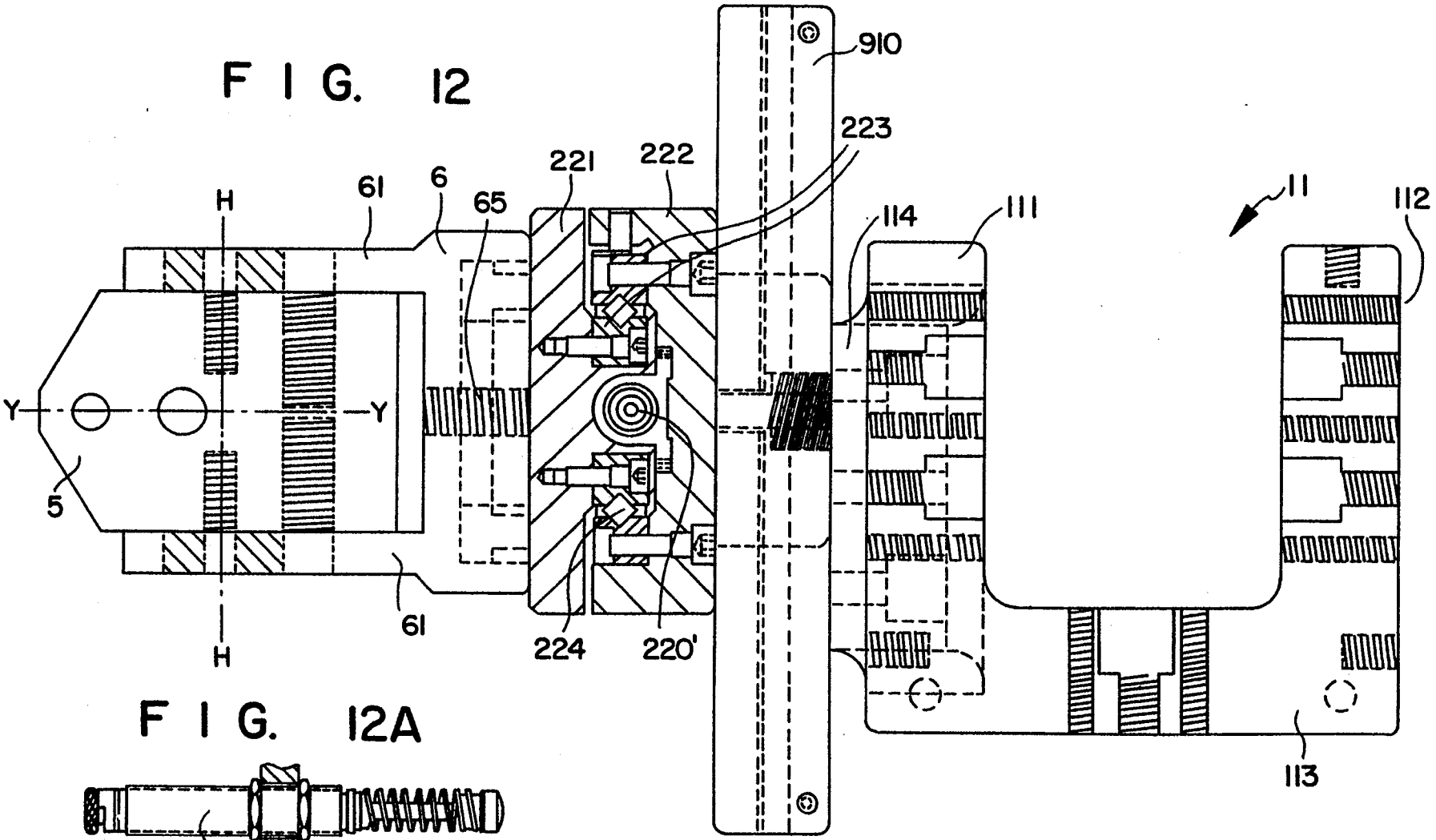
FIG. 12 is a view similar to FIGS. 4A, and 5A, in another variant.
Figure 12A:
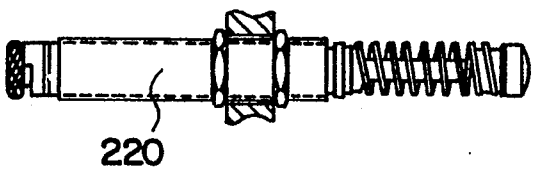
FIG. 12A is a shock absorber.

FIGS. 12 and 12A shown another variant of the invention, which corresponds substantially to the embodiment in FIGS. 1 and 2, and has the same references for identical units and means.

In this variant, the device is provided with a hydraulic shock absorber 220 fitted between the two parts 221, 222 of a straight guiding cradle, which additionally comprises sliding rails 223, 224. A shock absorber of this type, which is known per se, does not require a detailed description. The part 222 supports the two plates 9, 10, each of which receives a support 11, 12.

In general the lateral plates and the U-shaped supports can be parts produced by machining and/or casting, and of which the sliding surfaces of the sliding grooves or the like means, are machined in a specific manner in order to facilitate the adjustments. Additionally, the sliding parts can be provided with wear runners.

It should be noted that preferably, all the metal parts are made of stainless alloys, or are corrosion-proofed.

The various machined parts have the largest possible interface areas, in order to ensure that the device has the best possible propagation of vibratory effects and shock waves towards the ground.

In general, the adjustment or articulation connections between the various parts are produced using means which guarantee perfect, reliable locking of the adjustments selected.

I claim:

1. Portable device for immobilising fire arms during adjustment firing, characterised in that in that it comprises a seating (1) intended to be attached to an existing support (100) by attachment means (2, 3), this seating (1) supporting so as to pivot about a first axis (XX) a plate (6) which accommodates a rail (8) (axis X1X1) which in turn is mounted so as to pivot (7) on the plate (6) about a second axis (YY) which is perpendicular to the first axis (XX), the rail (8) receiving in a sliding manner along its axis (X1X1) at least two plates (9, 10) with adjustment slides (13), of which the slides are perpendicular to the axis of the rail (8) (X1X1) and to the axis of pivoting (YY) of the rail, a U-shaped support (11, 12) mounted in the slide (13) of each plate (9, 10) and provided with attachment means (27, 28, 29) intended to accommodate the weapon to be adjusted.

2. Device according to claim 1, characterised in that the plate (6) is connected to the seating (1) by an intermediate part (5) for correction of the course.

3. Device according to claim 1, characterised in that the seating (1), which is provided with tooled edges, consists of a U-shaped profile provided with reinforcement covering parts.

4. Device according to claim 1, characterised in that the plate (9, 10) with an adjustment slide (13) is a part in the shape of an inverted T, of which one leg comprises the adjustment slide (13) and the other contains the recesses for the attachment screws (22, 23) for the plate on the rail (8).

5. Device according to claim 1, characterised in that the U-shaped support comprises two "vertical" legs (111, 112) which are connected by a transverse leg (111) supporting the attachment means (27, 28, 29) of the corresponding part of the weapon to be adjusted, as well as a flange (114) provided with a rule (115) which slides in the slide (13) and is locked in the position selected by tightening of screws carried by the U-shaped support.

6. Device according to claim 1, characterised in that the attachment means (2, 3) of the seating (1) on the existing support (100) are straps.

7. Device according to claim 5, characterised in that the attachment means (27, 28, 29) for the weapon are balls and socket bases.

8. Device according to claim 2, characterised in that the plate (6) comprises two cheek pieces (61) which cover the block forming the intermediate part (5), and the plate (6) is locked on the intermediate part (5) by screws (63), and in particular by bracing screws.

9. Device according to claim 1, characterised in that it comprises locking means (200, 207) for the plate (6) relative to the seating (1), locking means (202, 204, 205, 206) for the rail (8) relative to the plate (6), and means for locking the weapon in the supports (11, 12) vertically (211) and longitudinally (recoil stop 208).

10. Device according to claim 1, characterised in that the supports (11, 12) for the weapon are connected to the seating (1), with a longitudinal shock absorber (220) interposed.

* * * * *